US009188131B2

(12) United States Patent
Speretta et al.

(10) Patent No.: US 9,188,131 B2
(45) Date of Patent: Nov. 17, 2015

(54) FAN UNIT FOR A HEAT EXCHANGER

(71) Applicant: Johnson Electric S.A., Murten (CH)

(72) Inventors: Gianni Speretta, Asti (IT); Francesco Murador, Asti (IT)

(73) Assignee: JOHNSON ELECTRICS S.A., Murten (CH)

( * ) Notice: Subject to any disclaimer, the term of this patent is extended or adjusted under 35 U.S.C. 154(b) by 264 days.

(21) Appl. No.: 13/715,215

(22) Filed: Dec. 14, 2012

(65) Prior Publication Data

US 2013/0156619 A1 Jun. 20, 2013

(30) Foreign Application Priority Data

Dec. 15, 2011 (IT) ..... TO20110139

(51) Int. Cl.
*F04D 25/06* (2006.01)
*F04D 13/06* (2006.01)
*F04D 19/00* (2006.01)

(52) U.S. Cl.
CPC ..... *F04D 25/0693* (2013.01); *F04D 13/0693* (2013.01); *F04D 19/002* (2013.01)

(58) Field of Classification Search
CPC ... H02K 5/22; F04D 13/0693; F04D 25/0693; F04D 19/002; F04D 25/08; F04D 29/403
USPC ..... 417/423.1, 423.7, 423.14, 423.15, 417/423.9; 310/71; 174/260, 72 A, 72 C, 50, 174/520
See application file for complete search history.

(56) References Cited

U.S. PATENT DOCUMENTS

| | | | | |
|---|---|---|---|---|
| 4,756,697 | A * | 7/1988 | Hefling | 439/568 |
| 6,549,406 | B1 * | 4/2003 | Olesiewicz et al. | 361/695 |
| 6,755,631 | B2 * | 6/2004 | Kawashima et al. | 417/572 |
| 6,808,411 | B2 * | 10/2004 | Chen | 439/485 |
| 2008/0020698 | A1 * | 1/2008 | Spaggiari | 454/139 |

* cited by examiner

*Primary Examiner* — Justin Jonaitis
*Assistant Examiner* — Stephen Mick
(74) *Attorney, Agent, or Firm* — Muncy, Geissler, Olds & Lowe, P.C.

(57) ABSTRACT

A fan unit for a heat exchanger, particularly for a motor vehicle, has a support structure or cowling having a main aperture forming a passage for a flow of air, and an electric fan having an impeller and an electric motor. A flexible electrical cable connects the motor to a source of supply voltage and/or to an associated control circuit. The cable has a terminal electrical connector having a body with one end connected to the cable, and another end provided with at least one connection aperture. A seat is provided in the support structure or cowling for receiving and retaining the terminal electrical connector, and for covering the at least one connection aperture of the connector.

5 Claims, 2 Drawing Sheets

FAN UNIT FOR A HEAT EXCHANGER

CROSS REFERENCE TO RELATED APPLICATIONS

This non-provisional patent application claims priority under 35 U.S.C. §119(a) from Patent Application No. TO2011U000139 filed in Italy on Dec. 15, 2011.

FIELD OF THE INVENTION

This invention relates to a fan unit and in particular to a cooling fan module for a heat exchanger such as a radiator of a motor vehicle.

BACKGROUND OF THE INVENTION

More specifically, the invention relates to a fan unit of the type comprising an essentially plate-like support structure or cowling, having a main aperture forming a passage for a flow of air, and an electric fan. The fan includes an impeller having a central hub from which a plurality of blades extends, and an electric drive motor fixed to a support structure in the central area of the passage and connected to the hub of the impeller. The motor also has a flexible electrical cable having a terminal electrical connector for connection to a source of supply voltage and/or to associated control circuit. The connector has a body having one end connected to the cable and the other end provided with at least one connection aperture.

When fan units of this type are transported from the manufacturing site to the assembly site, the electrical terminal connectors may be damaged and/or may be penetrated by foreign bodies.

Hence there is a desire for a fan unit which can overcome the aforementioned drawbacks of prior art fan units.

SUMMARY OF THE INVENTION

Accordingly, in one aspect thereof, the present invention provides a fan unit for a heat exchanger, particularly for a motor vehicle, comprising: an essentially plate-like support structure or cowling, having a main aperture forming a passage for a flow of air; an electric fan comprising: an impeller having a central hub from which a plurality of blades extends, and an electric drive motor fixed to a support structure in the central area of the passage and connected to the hub of the impeller; a flexible electrical cable connected to the motor, having a terminal electrical connector for connection to a source of supply voltage and/or to an associated control circuit, wherein the connector has a body having one end connected to the cable, and another end provided with at least one connection aperture; and a seat provided in the plate-like support structure or cowling, in the proximity of the aforesaid main aperture, for receiving and retaining the body of the terminal electrical connector, and for covering the at least one connection aperture of the connector.

Preferably, the seat comprises: a pair of sprung retaining appendages, preferably positioned facing one another, and capable of engaging from opposite sides and retaining a portion of the body of the electrical connector; and an essentially C-shaped retaining and protecting bulkhead, spaced apart from the pair of retaining appendages, and having an intermediate portion for abutting the other end of the body of the connector, and two opposing terminal portions, facing towards the appendages and designed to enclose, from opposite sides, the other end of the body of the connector.

Preferably, the retaining appendages and the retaining and protecting bulkhead extend essentially orthogonally to a portion of the surface of the support structure or cowling.

Preferably, the retaining appendages and the retaining and protecting bulkhead are made integrally with the support structure or cowling.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
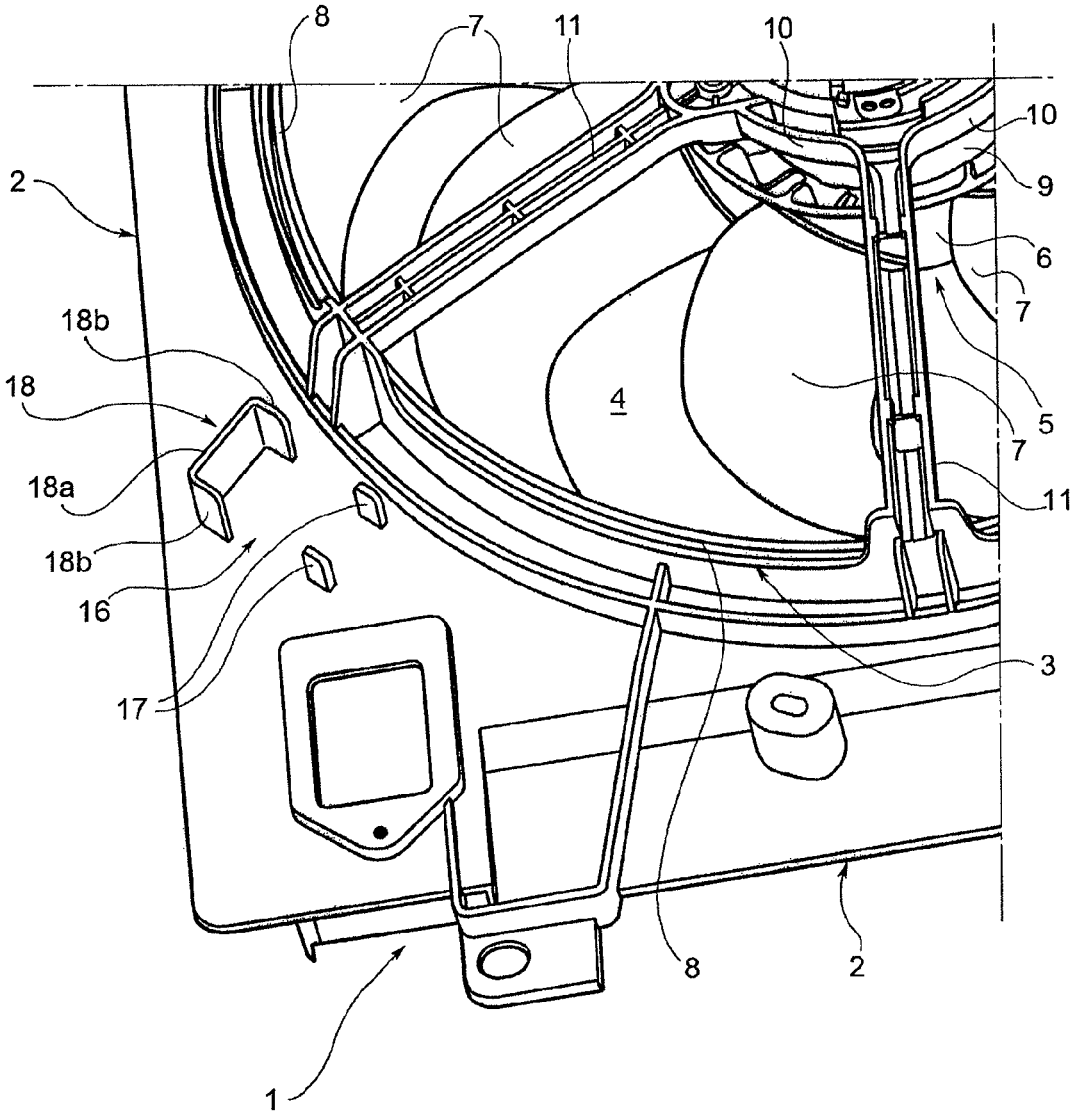
FIG. 1 is a near frontal partial view of a fan unit according to the preferred embodiment of the present invention.

The number 1 in FIG. 1 indicates the whole of a fan unit according to the invention, for a heat exchanger (of a known type, which is not illustrated), particularly for a motor vehicle.

The fan unit 1 essentially comprises an essentially plate-like support structure or cowling 2, generally made of moulded plastic material. This structure or cowling 2 has an essentially circular main aperture 3, forming a passage 4 for a flow of air.

The fan unit 1 further comprises an impeller 5 having a central hub 6 from which a plurality of blades 7 extends. In the illustrated embodiment, the radially outer ends of the blades 7 are connected to a peripheral ring 8, which extends in the proximity of the edge of the aperture 3 of the support structure or cowling 2.

The hub 6 of the impeller 5 is connected to an electric drive motor 9, fixed to a support structure which, in the illustrated embodiment, essentially comprises a ring 10 located in the central area of the ventilation passage 4, and a plurality of spokes 11 whose distal ends are connected to the support structure 2 outside the edge of the aperture 3. The ring 10 and the spokes 11 are conveniently made in one piece with the support structure or cowling 2.

Figure 2:
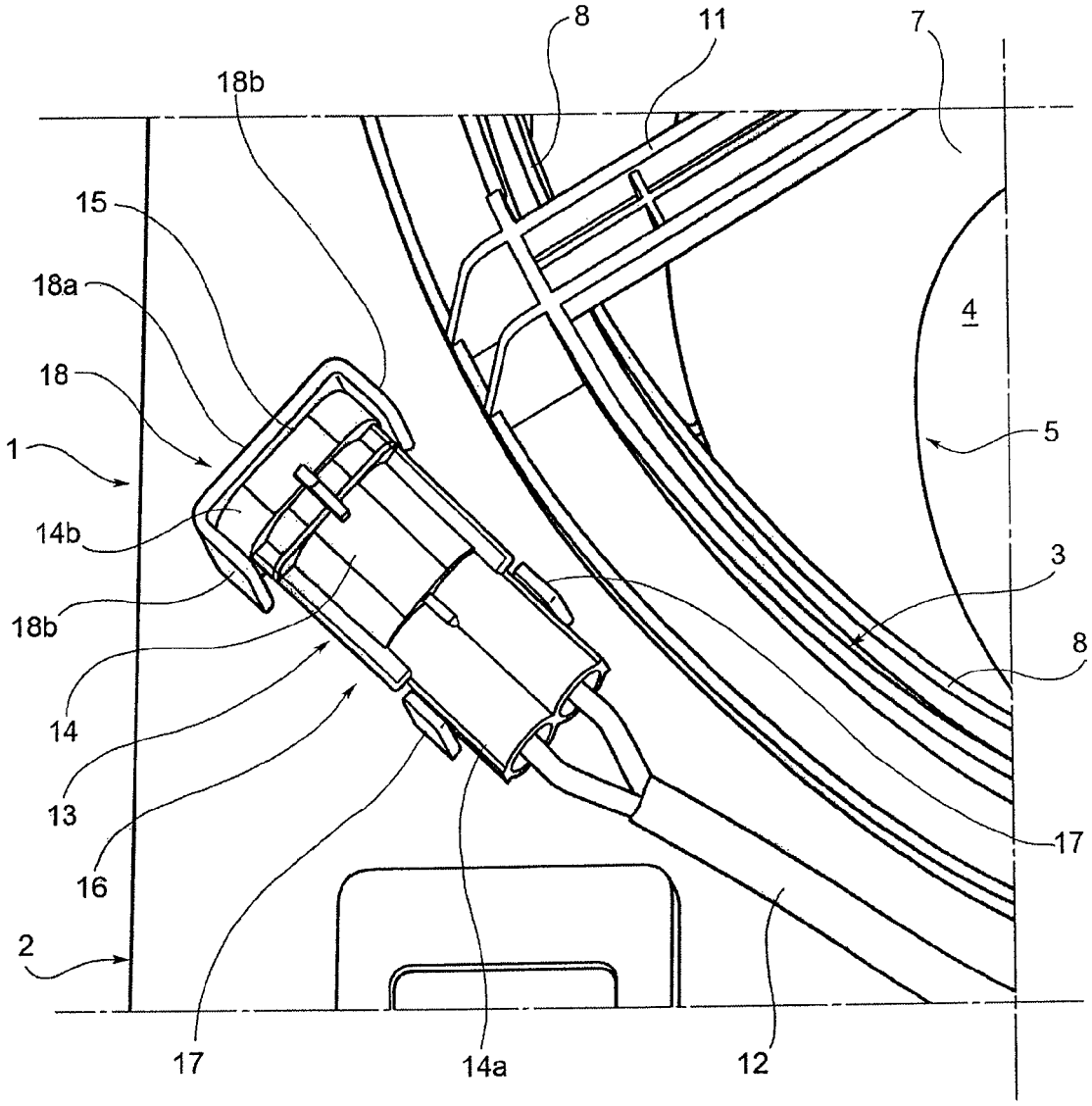
FIG. 2 shows, on an enlarged scale, a detail of FIG. 1, with the connector of the electrical connecting cable of the fan unit fitted into the corresponding seat in the support structure or cowling.

The electric motor 9 for driving the impeller 5 is provided with a flexible electrical cable indicated by 12 in FIG. 2. This cable 12 has a terminal electrical connector 13 for connection to a source of supply voltage and/or to an associated control circuit (not shown). In a known way, the connector 13 has a body 14, made of moulded plastic material for example, and has one end 14*a* connected to the flexible cable 12 and another end 14*b* having at least one terminal connection aperture 15.

According to the present invention, a seat 16 is formed in the support structure or cowling 2, preferably in the proximity of the main aperture 3, the seat being adapted to receive and retain the body 14 of the terminal connector 13, while covering the terminal connection aperture or apertures 15, and preventing any damage to the connector and any penetration of foreign bodies into it during transport from the manufacturing site of the fan unit 1 to the installation site.

In the illustrated embodiment, the seat 16 comprises a pair of sprung retaining appendages 17, facing one another, and capable of engaging from opposite sides, and retaining in a releasable way, an intermediate portion of the body 14 of the electrical connector 13.

The seat 16 further comprises an essentially C-shaped retaining and protecting bulkhead 18, spaced apart from the retaining appendages 17. In particular, this bulkhead 18 has an intermediate portion 18*a*, for abutting and closing the end 14*b* of the body 14 of the connector 13, and two opposing terminal portions 18*b*, facing towards the appendages 17 and designed to enclose, from opposite sides, the end 14*b* of the body 14 of the connector.

The retaining appendages 17 and the retaining and protecting bulkhead 18 extend essentially orthogonally to a portion of the surface of the support structure or cowling 2. The retaining appendages 17 and the retaining and protecting bulkhead 18 are conveniently made integrally with the support structure or cowling to form a single monolithic structure, preferably as a single plastic molding.

FIG. 2 shows the connector 13 positioned in the seat 16: its end 14*b* abuts the intermediate portion 18*a* of the bulkhead 18, between the terminal portions 18*b* of the bulkhead, and its other end extends beyond the sprung retaining appendages 17.

The connector 13 positioned in the seat 16 is protected from damage and/or from intrusions of foreign material into it in all the operations which take place between the assembly of the ventilator unit 1 and the subsequent mounting of this unit in a motor vehicle.

Clearly, provided that the principle of the invention is retained, the forms of embodiment and the details of construction can be varied widely from what has been described and illustrated, without thereby departing from the scope of the invention as defined in the attached claims.

In the description and claims of the present application, each of the verbs "comprise", "include", "contain" and "have", and variations thereof, are used in an inclusive sense, to specify the presence of the stated item but not to exclude the presence of additional items.

The invention claimed is:

1. Fan unit for a heat exchanger, comprising:

an essentially plate-like support structure or cowling, having a main aperture forming a passage for a flow of air;

an electric fan comprising: an impeller having a central hub from which a plurality of blades extends, and an electric drive motor fixed to a support structure in the central area of the passage and connected to the hub of the impeller;

a flexible electrical cable connected to the motor, having a terminal electrical connector for connection to a source of supply voltage and/or to an associated control circuit, wherein the terminal electrical connector has a body having one end connected to the cable, and another end of the body provided with at least one connection aperture; and a seat having a retaining and protecting bulkhead, the seat being provided in the plate-like support structure or cowling, in the proximity of the aforesaid main aperture, for receiving and retaining the body of the terminal electrical connector, and for covering the at least one connection aperture of the connector, the bulkhead having a surface contacting and covering the at least one connection aperture.

2. The fan unit of claim 1, wherein the seat further comprises:

a pair of sprung retaining appendages, positioned facing one another, and capable of engaging from opposite sides and retaining a portion of the body of the electrical connector; and wherein the retaining and protecting bulkhead is essentially C-shaped and spaced apart from the pair of sprung retaining appendages, and has an intermediate portion for abutting the another end of the body of the connector, and two opposing terminal portions, facing towards the appendages and designed to enclose, from opposite sides, the another end of the body of the connector.

3. The fan unit of claim 2, wherein the sprung retaining appendages and the retaining and protecting bulkhead extend essentially orthogonally to a portion of the surface of the support structure or cowling.

4. The fan unit of claim 2, wherein the retaining appendages and the retaining and protecting bulkhead are made integrally with the support structure or cowling as a monolithic structure.

5. The fan unit of claim 3, wherein the retaining appendages, the retaining and protecting bulkhead and the support structure or cowling are formed as a monolithic structure.

* * * * *